US005234011A

United States Patent [19]

Lynch

[11] Patent Number: 5,234,011

[45] Date of Patent: Aug. 10, 1993

[54] CLEAR SPAN TENT STRUCTURE

[76] Inventor: James P. Lynch, 13 S. Field, Lakewood, Colo. 80226

[21] Appl. No.: 740,001

[22] Filed: Aug. 2, 1991

[51] Int. Cl.[5] ..... E04H 15/26

[52] U.S. Cl. ..... 135/99; 135/114; 135/115

[58] Field of Search ..... 135/102, 115, 908, 100, 135/87, 119, 99, 97; 52/80

[56] References Cited

U.S. PATENT DOCUMENTS

| | | | |
|---|---|---|---|
| D. 316,288 | 4/1991 | Lynch . | |
| 1,326,006 | 12/1919 | Sterhardt . | |
| 1,493,915 | 5/1924 | Baker . | |
| 1,728,356 | 9/1929 | Morgan . | |
| 1,853,367 | 4/1932 | Mace . | |
| 2,135,961 | 11/1938 | Chenoweth . | |
| 2,349,993 | 5/1944 | Schwimmer et al. | 135/908 X |
| 2,440,557 | 4/1948 | Power . | |
| 2,716,992 | 9/1955 | Campfield et al. | 135/99 |
| 2,770,243 | 11/1956 | Miller . | |
| 2,928,404 | 3/1960 | Klages . | |
| 3,751,862 | 8/1973 | Linecker | 135/97 X |
| 3,886,961 | 6/1975 | Geiger et al. | 135/102 X |
| 4,112,956 | 9/1978 | Small | 135/118 X |
| 4,367,761 | 1/1983 | Winant | 135/87 |
| 4,607,656 | 8/1986 | Carter . | |
| 4,641,676 | 2/1987 | Lynch . | |
| 4,779,635 | 10/1988 | Lynch . | |
| 4,942,895 | 7/1990 | Lynch | 135/908 X |

FOREIGN PATENT DOCUMENTS

| | | | |
|---|---|---|---|
| 823693 | 10/1937 | France . | |
| 0387919 | 5/1965 | Switzerland | 135/99 |
| 15851 | of 1886 | United Kingdom . | |
| 656361 | 1/1949 | United Kingdom . | |
| 8203317 | 10/1982 | World Int. Prop. O. | 135/907 |

*Primary Examiner*—Richard E. Chilcot, Jr.
*Assistant Examiner*—Lan M. Mai
*Attorney, Agent, or Firm*—Timothy J. Martin; Dana S. Rewoldt

[57] ABSTRACT

An erectable tent structure is formed by a flexible roof covering that includes a central portion and a plurality of ridge portions that have inclined slopes and that extend along ridgelines radially outwardly and upwardly from the central portion to terminate in peaks located at the periphery of the roof covering. the slopes thus form valley portions between the ridgelines, and the valley portions have valley floors that slope radially outwardly and downwardly from the central portion. A support pole supports the roof covering at reach peak, and anchor structures secure the flexible covering to the support surface in a manner that a ridge tension force is applied upwardly and outwardly along the ridgelines and a valley tension force is applied downwardly and outwardly along the valley floors. The ridge and valley portions may be formed by joined panels so that there is a primary seam along each ridgeline and a secondary seam along each valley floor. The anchor structure preferably is a triangular anchor section joined to the flexible roof covering at the periphery between each mouth of the valley portions so as to span a respective peak. The vertex of the anchor panel is securable, to the support surface.

20 Claims, 6 Drawing Sheets

CLEAR SPAN TENT STRUCTURE

FIELD OF INVENTION

The present invention is directed to a tent structure that is erectable on a support surface such as the ground, paved areas and the like. The tent structure specifically relates to large area tents which may be conveniently stored in a relatively small space, but, when erected, provide a protected space adapted for concessions, merchandise displays, assemblies, to name a few uses. With greater particularity, however, the present invention concerns tent structures which have support poles located around their periphery, as opposed to a center pole structure, so that the protected or sheltered area is not obstructed by central pole assemblies. In the industry, this type of structure is known as a clear-span tent, canopy or shelter.

BACKGROUND OF THE INVENTION

The desirability of large area shelters has long been recognized, and many industries employ pavilionlike shelters to protect against the elements, such as sun, wind and rain. These large area shelters are commonly used in commercial, fair, exhibit and party applications. One such example may be found in traveling shows and exhibits, such as merchandise exhibits, carnivals and the like.

Historically, large area tents are believed to have been first used by traveling shows, such as traveling circuses. These businesses found it necessary to employ large area tents as a staging arena for the circus activities. Yet another example of the need for large scale tents was early recognized by the military with its need for large area tent structures that could be rapidly erected and disassembled. More recently, merchants have implemented tent structures to provide additional space as a sheltered display area for their merchandise.

Despite the long felt need for large area tent structures, there has in the past been surprisingly little development in the industry of large sized tents. Examples of existing large area structures include the standard rectangular tent that has one or more apex portions supported by central poles; the perimeter of this tent covering is either supported by perimeter poles and with the peripheral edge of the tent being tensioned against a plurality of spikes or staked directly to the ground. Guy ropes are sometimes used to interconnect the perimeter to the stakes and block and tackle assemblies may be employed to tension the tent covering after it is erected. Another example of the traditional large area tent is the circus tent wherein margins of the tent are primarily stakes and center poles erected after which the apex portion of the tent is drawn up around the pole by means of pulleys; block and tackle assemblies are again employed to tension the circus tent against the stake elements.

In recent times, some efforts have been made again to create different tent structures which provide shelter and which are more aesthetically pleasing. These developments have, in part, stemmed from improvements of fabric technology, such as the development of lighter weight, stronger materials which more readily accept tension forces and which tend to better retain their shape under environmental conditions. However, even these recent tent designs often have relied on the old concept whereby the corners of the tent covering are individually and sequentially stressed against a constant length, erected center pole.

In response to the above described needs, I developed a new and useful tent structure which was both light weight and could be erected by a single person in a minimum amount of time. This tent structure is described in my U.S. Pat. No. 4,942,895 issued 24 Jul. 1990. In this construction, a pyramid shaped flexible covering is utilized, and the corner portions of this structure are first staked in a selected geometrical shape. An expandable center pole assembly is provided to position between the support surface and the vertex portion after staking the perimeter. The effective length of the center pole is then increased to raise the vertex portion away from the support surface thus uniformly applying tension to each of the anchored corner portions of the covering.

While existing large area tent structures are useful in sheltering an area against environmental elements, a disadvantage is found where a center pole construction is used. Thus, even though the tent structure described in my earlier patent provides significant advantages over prior art structures, the center pole design still hinders free movement of persons in the sheltered area and inhibits the arrangement of display cases, objects, tables, chairs and the like which are organized in a sheltered area.

It is recognized that the canopy and tent industry desires tent structures which are known as "clear-span" structures which avoid the use of a center pole construction. While small area clear-span structures are not difficult to achieve, large area, clear-span structures have been found to be difficult to construct due to the tension forces and weights of material between peripheral support poles. A further difficulty is found in constructing large, clear-span structures since rainwater tends to collect on the roof covering when a center pole is eliminated since an elevated apex located centrally of the structure cannot be obtained without a center pole. The weight of water collecting on the canopy roof can cause the covering to tear, collapse or otherwise fail in providing an adequate sheltered space.

Therefore, despite prior art structures, including that described in my own patent, there remains a need for large area clear-span tent structures which eliminate center pole supports. There is a further need for these clear-span structures to be relatively light weight yet which can be easily erected by one or a small number of persons. There is a further need for such a structure which can withstand environmental elements with reduced danger of failure.

SUMMARY OF THE INVENTION

It is an object of the present invention to provide a new and useful tent structure which may be stored in a small, compact area yet which may be erected on a support surface with relative ease.

Another object of the present invention is to provide an erectable tent structure of the "clear-span" type so that a large area is sheltered by the structure without the use of one or more center pole assemblies.

A further object of the present invention is to provide an erectable tent structure of a clear-span type which suitable drains rainwater therefrom with reduced chance for failure.

Still a further object of the present invention is to provide a tent structure that can be configured in a variety of regular, even numbered geometric shapes in a manner that is highly aesthetically pleasing yet which at the same time exhibits strength to resist environmental elements.

Yet another object of the present invention is to provide an erectable tent structure which is supported at its periphery by peripheral poles and anchor sections which apply dynamic tension to the central portion of the tent structure in an upward and outward direction as well as in a downward and outward direction, radially from the center, so that a stable, clear-span is obtained for the roof covering.

According to the broad form of the present invention, then, an erectable tent structure is provided for erection on a support surface to provide a sheltered space. The tent structure includes a flexible roof covering which has a periphery and which includes a central portion and a plurality of ridge portions which extend radially outwardly from said central portion along ridgelines. Each ridge portions terminates in a peak located approximate the periphery of the covering. Valley portions extend between adjacent ridgelines, and these valley portions likewise extend radially outwardly from the central portion between a pair of adjacent ridge portions to terminate in a valley mouth located approximate the periphery of the covering. Each of the valley portions thus has a valley floor and a pair of inclined slopes which extend upwardly from the valley floor oppositely one another to form the ridge portions. A plurality of support poles are provided to support the flexible covering in an erected state by extending between each peak and the support surface. Anchoring structures then secure the flexible covering to the support surface and apply a ridge tension force along each ridgeline in a direction upwardly and outwardly with respect to the central portion. At the same time, a valley tension force is supplied along each valley floor in a direction downwardly and outwardly with respect to the central portion. Thus, the flexible covering is held taut with the central portion being oriented in a plane relatively parallel to the support surface. The covering is so configured that, in the erected state, the ridgelines each extend above the plane containing the central portion while the valley floors extends below the horizontal plane.

In the described embodiments, the erectable tent structure according to the present invention includes support poles that are adjustable in effective length so as to allow the ridge and valley tension forces to be selectively varied. The anchor structure is preferably in the form of flexible, triangular anchor sections which are joined along portions of the periphery of the roof covering and extend outwardly to terminate in anchor shoes which may matably receive stakes mounted in the ground. In one embodiment, each anchor section extends around a portion of the periphery which spans a peak of a selected ridge while in another embodiment, each anchor section spans a valley portion of the periphery of the covering. That is, in the first instance, the anchor section extends from valley floor to valley floor while in the second instance, the anchor section extends from peak to peak. In either case, adjacent ones of the anchor sections form archways having crests located proximate to the periphery of the roof covering to permit ingress into and egress out of the sheltered area.

Preferably, the ridge portions and the valley portions are constructed out of a plurality of fabric panels, such as nylon, which are cut and seamed together so that the ridgelines and the valley floors are formed by seams which run parallel to either the warp or weft threads of the joined panels. Intermediate seams are formed by bias and swarf cuts which are then joined to contour the covering and anchor sections in a desired configuration. The primary seams forming the ridgelines and the secondary seams forming the valley floors are preferably reinforced with webbing strips as are the anchor section edges. Mounting rings may be secured at each peak and may be reinforced by this webbing, and each support pole may include upper element that is matable with a mounting ring. Thus, support for the covering at each peak is accomplished by the engagement of the ring of each of the respective ring with respect support pole so that the fabric covering at the peak is protected against tearing. Similarly, a central ring may be provided so that the webbing strips may be attached thereto, and a cap piece may be stitched around the central ring to protect against leakage at the center portion.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

Figure 1:
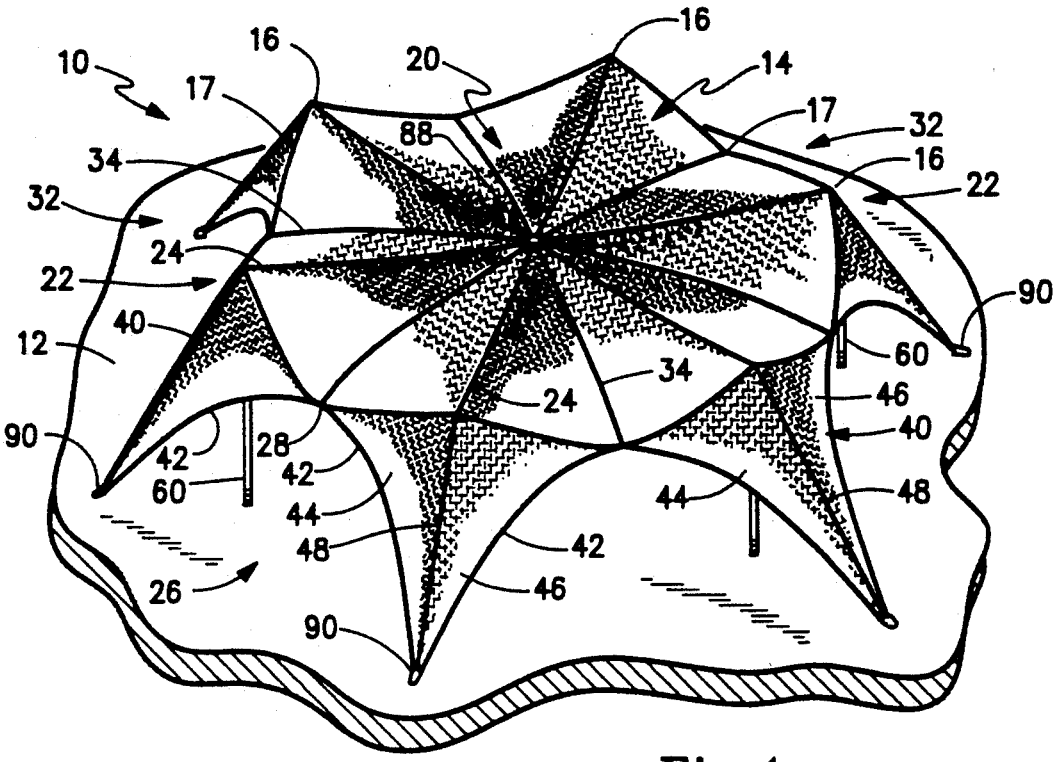
FIG. 1 is a perspective view of an erectable tent structure according to the preferred embodiment of the present invention shown in an erected state on a support surface.

The present invention is directed to a large area tent structure which is erectable on a support surface yet which may be stored in a relatively small, compact storage area when disassembled. Specifically, the present invention is directed to a clear-span tent structure which avoids the use of a center pole assembly and, instead, has support poles which extend around the periphery of the structure. Accordingly, a first exemplary embodiment of the this invention is shown in FIGS. 1–10 wherein like numbers refer to like parts. In these Figures, an erectable tent structure 10 is shown in an erected state (FIGS. 1–6) supported by a support surface 12 which may conveniently be the ground, pavement and the like. Tent structure 10 is supported by means of a plurality of support poles 60 which support a roof covering 14 at peaks 16 that define a periphery 18 for roof covering 14. Roof covering 14 is anchored to support surface 12 by means of a plurality of anchor assemblies 90 described more thoroughly below.

Figure 2:
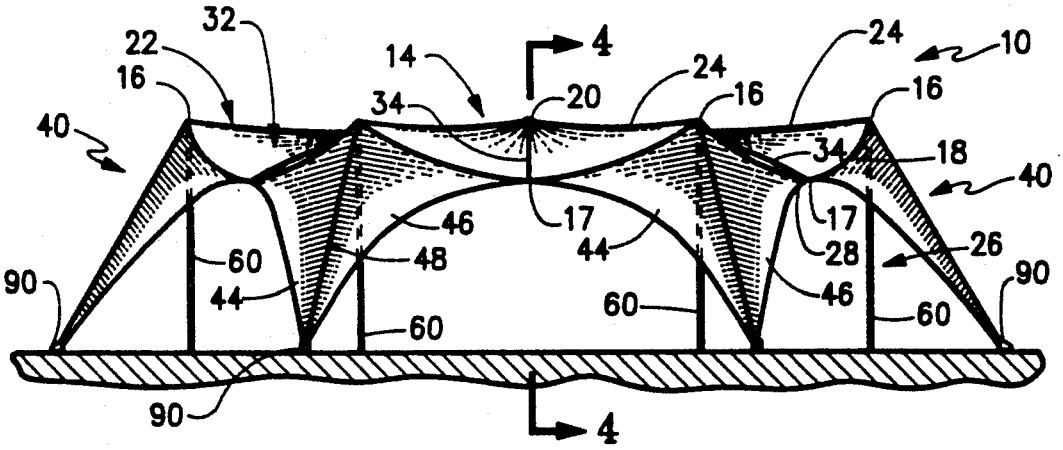
FIG. 2 is a side view in elevation showing the tent structure of FIG. 1.

Roof covering 14 has a central portion 20 from which a plurality of ridge portions 22 extend radially outwardly therefrom. Likewise, a plurality of valley portions 32 extend radially outwardly from central portion 20 so that ridge portions 22 and valley portions 32 alternate with one another. Thus, there is a valley portion 32 between each pair of adjacent ridge portions 22 and there is a ridge portion 22 between each pair of adjacent valley portions 32 as shown in FIGS. 1 and 2. It may thus be seen that each ridge portion 22 defines a ridgeline 24 that extends radially outwardly from central portion 20 to terminate at a respective peak 16 while each valley portion 32 has a valley floor 34 along a line that extends radially outwardly from central portion 20 to terminate in a valley mouth 17 located at periphery 18.

Figure 3:
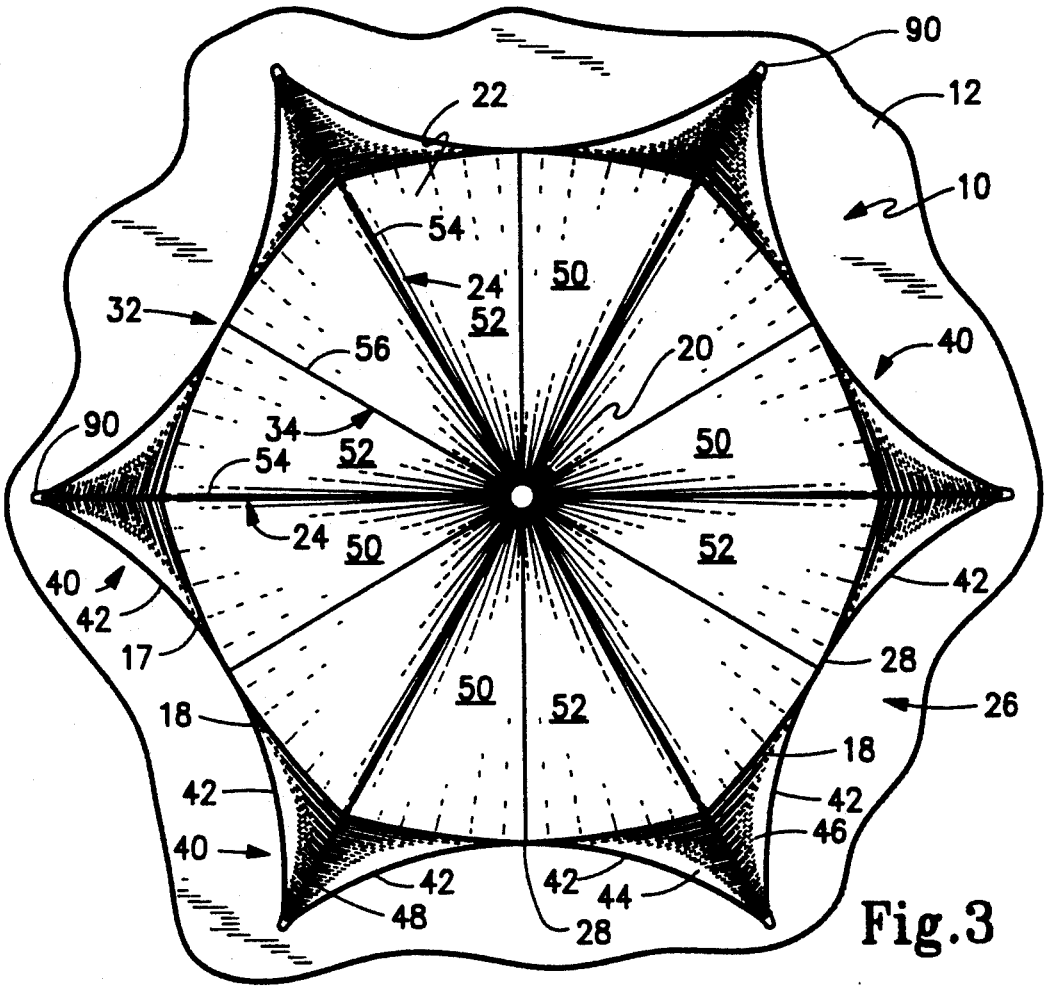
FIG. 3 is a top plan view of the tent structure shown in FIGS. 1 and 2.

With reference to FIG. 3, it may be seen that roof covering 14 of tent structure 10 is preferably formed by a plurality of roof sections defined by a pair of flexible fabric roof panels 50 and 52 which are joined together at a primary seam 54 that coincides with a respective ridgeline 24. Since the tent structure shown in FIGS. 1–3 is hexagonal in shape, there are six such roof sections. Each roof section is accordingly joined to an adjacent roof section by means of a secondary seam 56 which coincides with valley floor 34. Before discussing the construction of each roof section in detail, however, it should be noted with reference to FIGS. 1–3 that triangularly shaped anchor sections 40 are provided, and they are joined to the roof covering 14 along periphery 18 and have anchor section side edges 42 which converge an anchor end 41 that is connected to anchor assemblies 90 as described more thoroughly below. Each anchor section 40 includes a pair of anchor panels 44 and 46 which are also joined together at seam 48.

Figure 4:
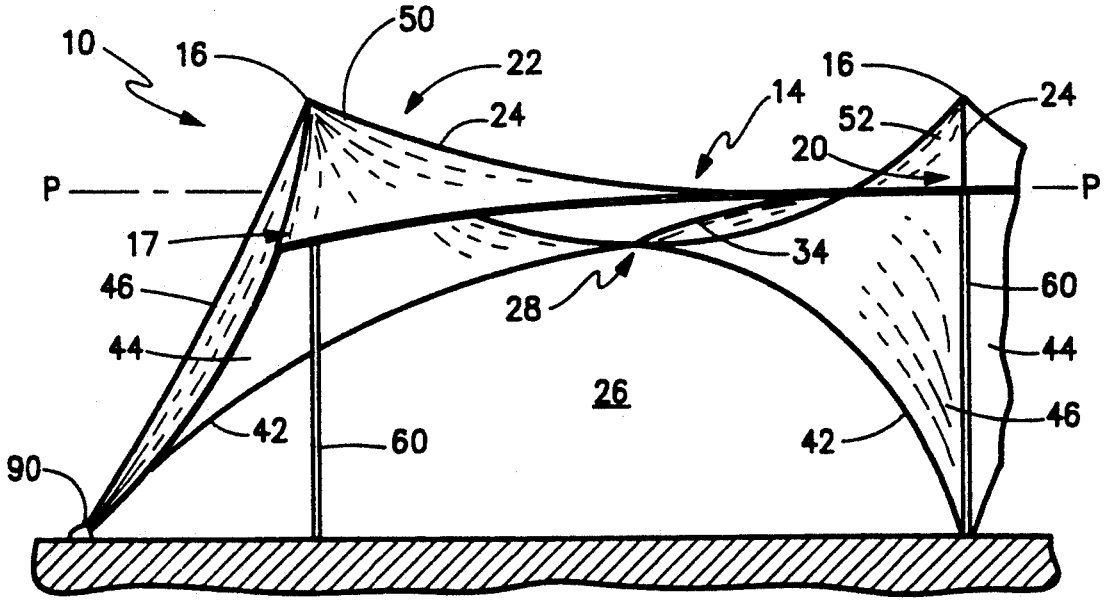
FIG. 4 is a cross-sectional view taken about lines 4—4 of FIG. 2, but showing only a representative half of the tent structure.
Figure 5:
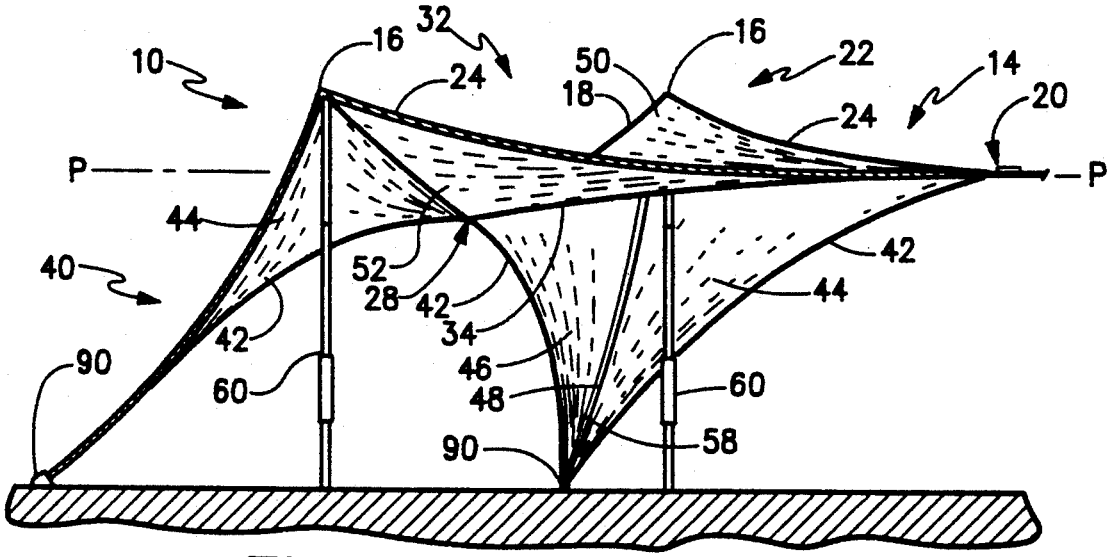
FIG. 5 is a view similar to FIG. 4 showing one-half of the tent structure of FIGS. 1 and 2 in cross-section in a direction angularly rotated 60° from the view in FIG. 4.

With reference to FIGS. 4 and 5, it may be seen that when tent structure 10 is in an erected state, support poles 60 are positioned between support surface 12 and each peak 16 with anchor sections 40 being secured to support surface 12 by means of anchor assemblies 90. Anchor sections 40 thus place tension on roof covering 14, with support poles 60 being in compression, so that a resultant ridge tension force is applied along each ridgeline 24 in a direction upwardly and outwardly with respect to central portion 20. Likewise, a valley tension force is applied each valley floor 34 in a direction downwardly and outwardly with respect to central portion 20 thus holding roof covering 14 in a taut condition. Furthermore, with the above construction, central portion 20 is oriented in a plane P which is generally parallel to support surface 12. Central portion 20 is oriented mid-way between each valley mouth 17 and each peak 16, and roof covering 14 is specifically constructed to accomplish this orientation. That is, in the erect state, ridgelines 24 of tent structure 10 extend radially upwardly and outwardly above plane P while each valley floor extends radially outwardly and downwardly below plane P. Therefore, roof covering 14 is contoured so that any water which falls thereon will run off of roof covering 14 by way of valley portions 32.

Furthermore, in reference to FIGS. 1–5, it may be seen that each anchor section 40 is joined along a portion of periphery 18 which extends between each pair of adjacent secondary seams 56 so as to extend from one valley mouth to another. Hence, each anchor section 40 spans a respective peak 16. Adjacent side edges 42 of adjacent ones of anchor sections 40 thus form an archway 26 having a crest 28 proximate periphery 18.

Figure 6:
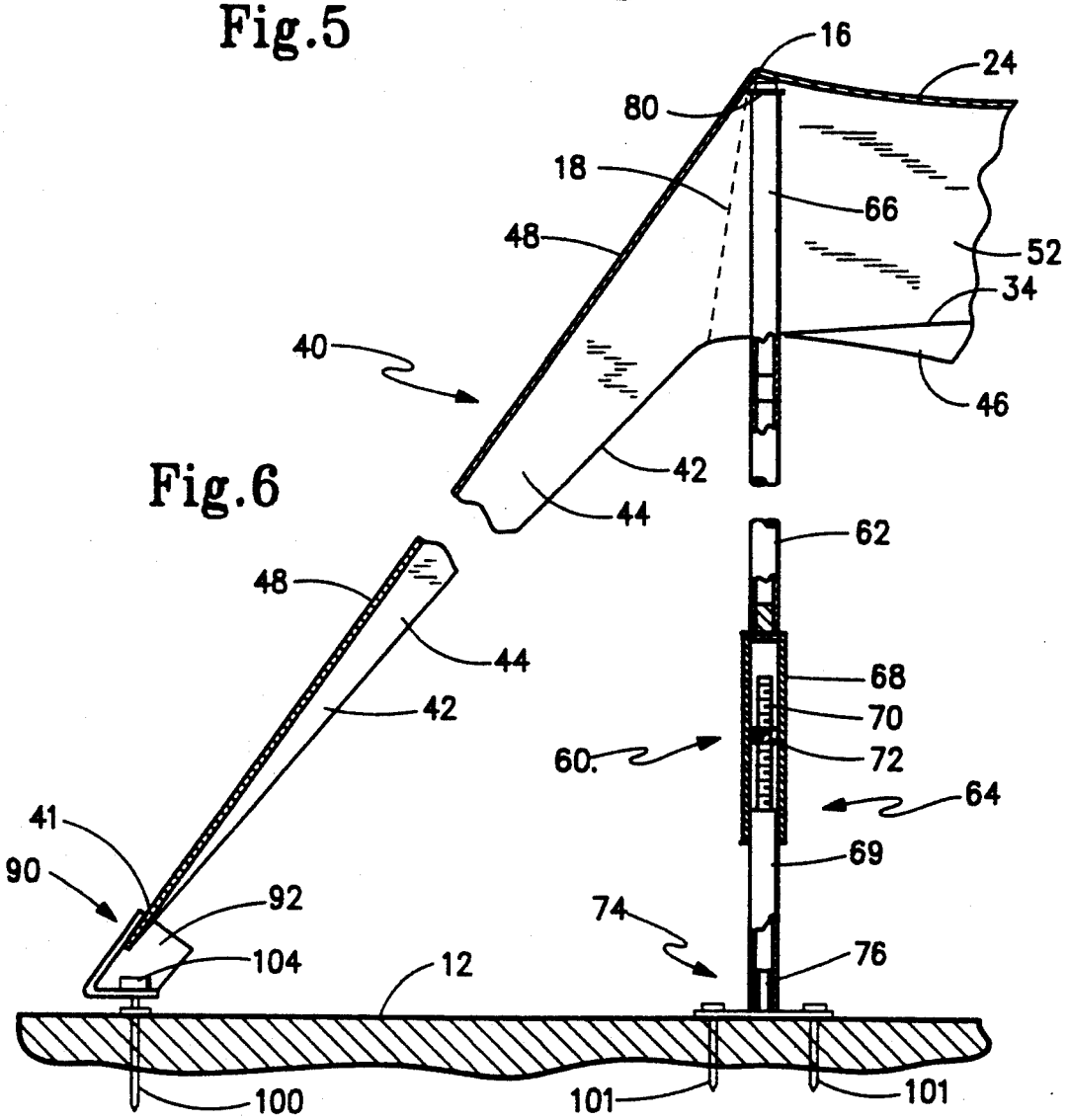
FIG. 6 is a cross-sectional view of a representative anchor section and peak for the tent structure shown in FIGS. 1 and 2 and shows the anchor shoe and stake assembly as well as the support pole in partial cross-section.
Figure 7:
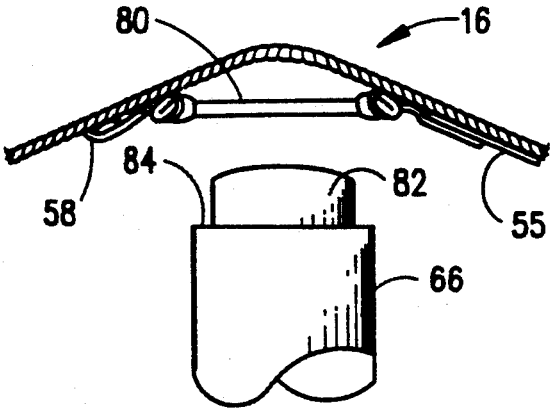
FIG. 7 is a side view in elevation and partial cross-section showing a representative peak mounting ring and upper portion of a support pole.
Figure 8:
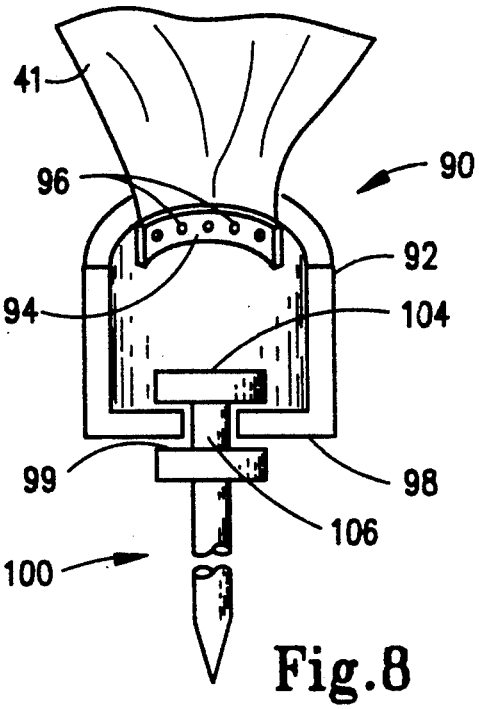
FIG. 8 is an end view showing the anchor shoe and stake assembly used to secure an anchor section of the tent structure to the support surface.

The construction of tent structure 10 as it relates to anchor sections 40, anchor assemblies 90 and peak 16 as well as the construction of support poles 60 are shown in greater detail with reference to FIGS. 6–8. In FIG. 6, for example, it may be seen that anchor assembly 90 is in the form of an arcuate shoe 92 which may be formed of metal or molded plastic material. Vertex end 41 of anchor section 40 is secured to shoe 90 by means of an arcuate mounting plate 94 fastened by means of screws or pins 96. Shoe 92 has a bottom plate 98 provided with a slot 99 configured to receive head 102 of stake 100. To this end, head 102 includes a pair of parallel, spaced-apart discs 104 so that shank 106 slides into slot 99 between heads 104. Of course, other anchor assemblies are within the scope of this invention.

Each support pole 60, as is representatively shown in FIG. 6, includes a plurality of pole sections such as intermediate pole section 62, bottom pole section 64 and top section 66 which linearly and releasably connect to one another. Bottom pole section 64 includes a pair of telescoping members 68 and 69 with section 69 including a threaded shaft 70 located internally of telescoping section 68. Telescoping section 68 includes a nut 72 which is rigidly affixed thereto and which may be threadably received on shaft 70 so that, as sections 68 and 69 are rotated relative to one another, bottom pole section 64 will expand and contract thus varying the effective length of support pole 60. Support pole 60 engages a mounting plate 74 which includes a post 76 onto which lower section 64 is seated with plate assembly 74 be suitably staked, if desired, to support surface 12 by means of stakes 101. With reference to FIGS. 6 and 7, it may be seen that peak 16 of tent structure 10 includes a mounting ring 80 which is secured to roof covering 14 by means of webbing strips 55 and 58 described below in reference to FIG. 10. Top pole section 66 terminates in a post 82 which is adapted to matably engage ring 80 so that ring 80 rests on shoulder 84 of post 66, as is shown in FIG. 6. Thus, forces exerted on peak 16 are borne by mounting ring 80 and web strips 55 and 58 rather than bearing on the weaker fabric material forming peak 16.

Figure 9:
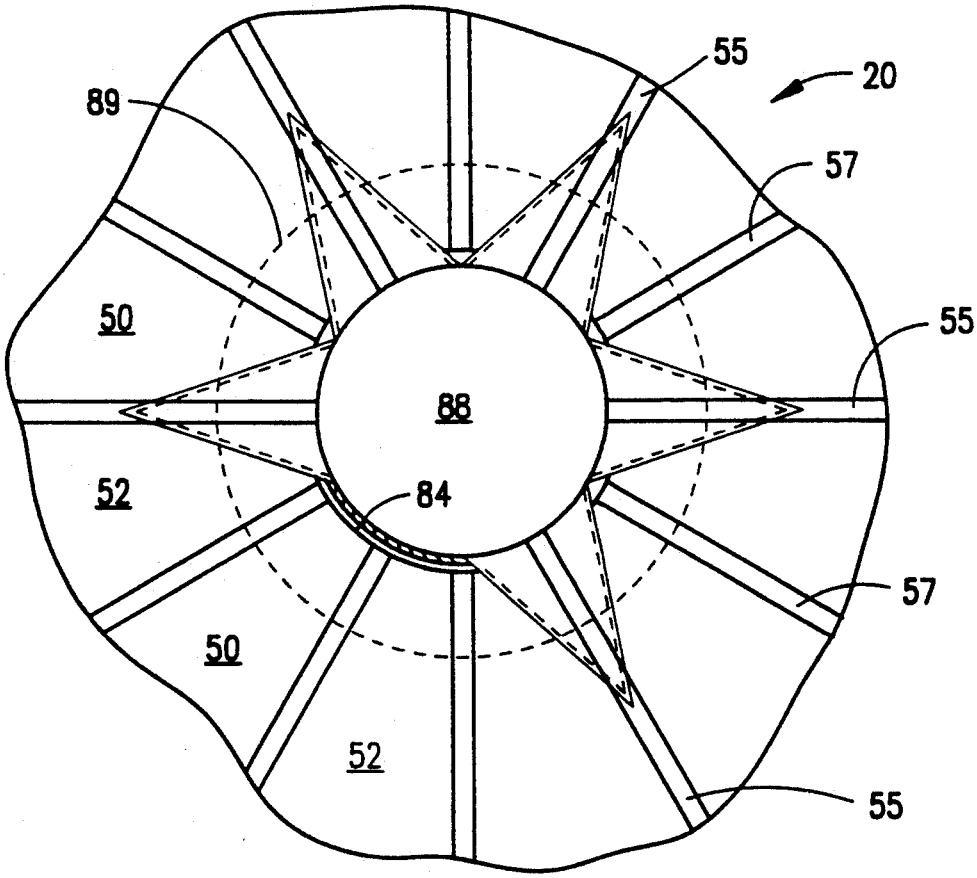
FIG. 9 is a bottom plan view, in partial cross-section, showing mounting ring and cap piece located at the central portion of the tent structure shown in FIGS. 1 and 2.

A central mounting ring is provided for central portion 20, as is shown in FIG. 9. Here, toroidal central ring 84 mounts on inner end of each roof section formed by roof panels 50 and 52. These inner ends are secured to ring 84 by reverse folding a triangular portion 86 therearound and sewing triangular portion 86 to the corresponding panels 50 and 52. Web strips 55 again reinforce this connection and reinforce each ridgeline. Likewise, web strips 57 reinforce this connection and each valley floor. To prevent ingress of water, a cap piece 88 is stitched over central mounting ring 84 along stitching line 89.

Figure 10:
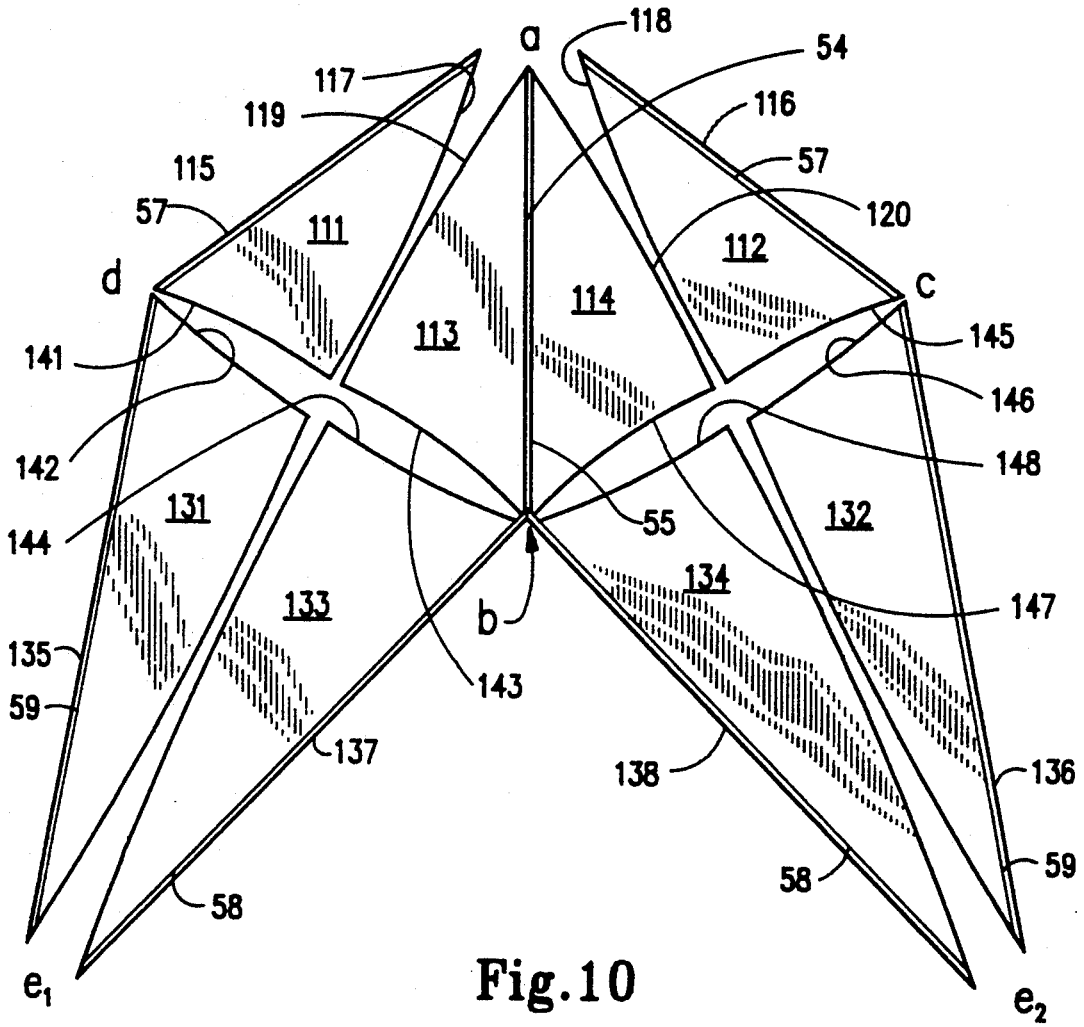
FIG. 10 is a top view showing the panel pieces which form a representative roof section and anchor section used to construct tent structures according to the preferred embodiment of the present invention.

The construction of a roof section and corresponding anchor section is best shown in FIG. 10 where it should be appreciated that, in the preferred embodiment, each roof section is formed by four panel pieces 111, 112, 113 and 114 while each anchor section is formed by four panels 131, 132, 133 and 134. Panel pieces 111, 113 together form a roof panel 52 while panel pieces 112 and 114 form a roof panel 50. Since each of panel pieces 111–114 and 131–134 are preferably formed of a fabric material, such as nylon, urethane backed polyester or other fabric material as used in tent and canopy manufacture. It should be appreciated that such fabric material has weft and warf threads which run perpendicular to one another.

Accordingly, triangular panel pieces 113 and 114 are cut so that they may be joined, such as by sewing, along primary seam line 54 which extends from points "a" and "b" with this primary seam line 54 being reinforced by webbing strip 55. Panel pieces 113 and 114 are cut so that their margins adjacent primary seam line 54 have either weft or warf threads running parallel to primary seam 54. Since primary seam 54 corresponds to ridgeline 24, the use of webbing strip 55 along with the orientation of this thread direction for panel pieces 113 and 114, increases the strength of the covering when ridge tension forces are applied, as described above.

Likewise, triangular panel pieces 111 and 112 are cut so that respective edges 115 and 116 are parallel to either the warf or weft threads of the fabric material. When a pair of adjacent roof sections together, it should be appreciated that edge 116 is connected, along "a" to "c" to an adjacent side 115 along line "a" to "d". The joining of an edge 116 to an edge 115 corresponds to the secondary seam along valley floor 34. Accordingly, reinforcing web strips 57 are provided. Web strips 57, in conjunction with the thread direction of panel pieces 111 and 112, increases the strength of the roof section along each valley floor 34 so as to withstand the valley tension forces described above.

Edges 117 118, 119 and 120 of pieces 111–114, respectively, are convexly swarf cut to allow for the selected contour of roof covering 14 and are joined together. This convex swarf cutting is provided to accommodate the selected contour of the roof covering 14 and, when panel pieces 111 and 113 are joined as well as panel pieces 112 and 114, reinforcement webbing (not shown) may be employed if desired.

Anchor section panel pieces 131–134 are constructed substantially similarly to panel pieces 111–114 and use similar swarf cuts to contour the anchor section. It should be noted with reference to FIG. 10 that edges 135–138 are all formed parallel to either the weft or warf threads of each respective panel pieces 131–134. Furthermore, edges 137 and 138 which respectively extend from point "b" to "$e_1$" and "$e_2$", respectively, are sewn together and a reinforcement webbing 58 is provided for this purpose. Reinforcement webbing 58, along with webbing 55 reinforce the anchor section against the ridge tension forces. Similarly, when adjacent anchor sections are connected, this is accomplished by sewing an edge 135 to an adjacent edge 136, and reinforcement webbing 59 may be provided to reinforce this construction against the valley tension forces described above.

Again with reference to FIG. 10, it should be understood that panel pieces 111, 113 are to be joined to panel pieces 131, 133 along convex swarf cut edges 141–144. Similarly, panel pieces 112, 114 are to be joined to panel pieces 132, 134 along convex swarf cut edges 145–148. The joining of these panel pieces together defines a perimeter portion or periphery 18 for roof covering 14 when all of the roof and anchor sections are joined. If desired, the joining of panel piece 111, 113 to panel pieces 131, 133 as well as the joining of panel pieces 112, 114 to panel pieces 132, 134 may be reinforced by webbing strips. In any event, then, the roof section is connected to an associated anchor section along lines b-c and b-d with point b thus forming the peak for the respective roof section. The various swarf cuts, both concave and convex, configure the roof section so that each peak and each valley mouth will be positioned on opposite sides of plane P; it should therefore be recognized that point "a" is located at central portion 20 when the tent structure is assembled.

To erect tent structure 10, it should be appreciated that the positioning of anchor assemblies 90 may be first selected by locating the desired position of the center of tent structure 10 and laying out those anchor points as described in my U.S. Pat. No. 4,942,895. Stakes 100 are then driven in at these points and a respective anchor shoe 92 secured thereto. Support poles 60 are assembled with bottom pole section 64 being rotated so that it is in a contracted state and these pole supports are placed into position by engaging each post 82 with respective mounting ring 80 and positioning each pole in an upright orientation. If desired, mounting plates 74 may be staked into position underneath each peak 16 or, if desired, these plates may be omitted. Once all of support poles 60 are in position, sections 68 and 69 may be rotated with respect to one another to apply tension to each peak 16 thereby drawing roof covering taut against each anchor section 40 by increasing the ridge and valley tension forces due to the expansion of the effective length of each support pole 60. Again, a variety of structures for expanding the effective length of support poles 60 could be used as available in the art.

While the embodiment described above was directed to a hexagonal tent structure, it should be appreciated that other geometrically shaped tent structures are within the scope of this invention. However, since it is desired that ridge tension forces extend from peak-to-peak while valley tension forces extend from valley mouth to valley mouth, the geometric shape selected is best where the roof covering has a regular polygonal shape with an even number of sides. One such embodiment is shown in the four sided tent structure of FIGS. 11 and 12 which further modify the joining of the respective anchor sections to the roof covering.

Figure 11:
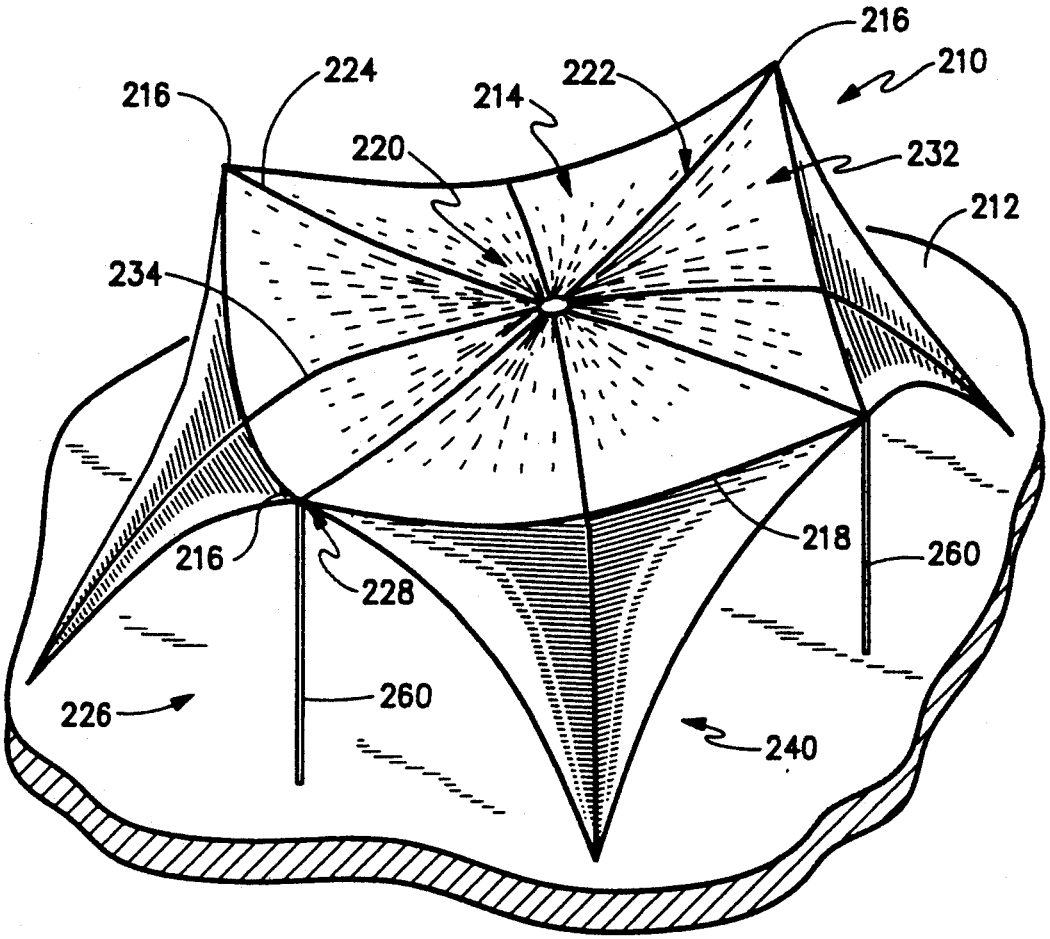
FIG. 11 is an alternate embodiment of the erectable tent structure of the present invention shown in perspective.
Figure 12:
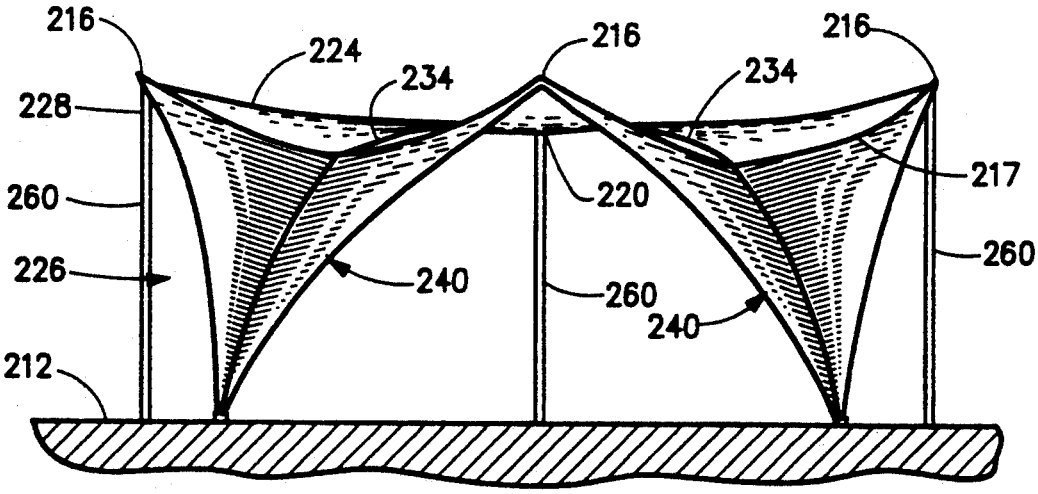
FIG. 12 is a side view in elevation showing the tent structure of FIG. 11.

With reference, then, to FIGS. 11 and 12, it may be seen that tent structure 210 has a roof covering 214 having a plurality of peaks 216 which are supported above support surface 212 by means of support poles 260. Thus, ridge portions 222 and valley portions 232 can include, respectively, ridgelines and valley floors such as ridgeline 224 and valley floor 234 which extend radially outwardly from central portion 220.

In this embodiment, however, as is shown in FIGS. 11 and 12, anchor sections 240 extend along a portion of the periphery 218 that spans the respective valley floors such that each anchor section 240 is joined to roof covering 214 between adjacent peaks 216. Thus, archway 226 has a crest 228 that is proximate periphery 218 at each peak 216. Once again, each peak and ridgeline is located above central portion 220 while each valley floor and valley mouth 217 is located below the plane of central portion 220 when in the erect state.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An erectable tent structure adapted to be erected on a support surface to provide a sheltered space, comprising:

(a) a flexible roof covering having a periphery and including a central portion and a plurality of ridge portions having inclined slopes and each extending radially outwardly from said central portion along a ridgeline to terminate in a peak located proximate to the periphery for said covering so that the inclined slopes of adjacent ones of said ridge portions form valley portions, each said valley portion extending radially outwardly from said central portion between a pair of adjacent ridge portions to terminate in a valley mouth located proximate to the periphery between the peaks of said adjacent ridge portions, each of said valley portions having as valley floor so that the inclined slopes forming each respective valley portion extend upwardly from said valley floor oppositely one another to said ridge portions;

(b) a plurality of support poles each having an effective length and operative to support said flexible covering in an erected state above said support surface, there being one of said support poles associated with each said peak such that each said support pole may be positioned between said support surface and a respective one of said peaks; and (c) a plurality of anchor means for securing said flexible covering to said support surface whereby a ridge tension force is applied along each ridgeline in a direction upwardly and outwardly with respect to said central portion and whereby a valley tension force is applied along each valley floor in a direction downwardly and outwardly with respect to said central portion so that said flexible covering is held taut when in the erected state with said central portion being located in a plane parallel to said support surface, said covering configured so that, in the erected state, said ridgelines each extend above said plane and slope downwardly from said peaks to said central portion and said valley floors extend below said plane and slope downwardly from said central portion to said periphery.

2. An erectable tent structure according to claim 1 wherein each of said support poles includes means for adjusting the effective length thereof whereby the ridge and valley tension forces may be selectively varied.

3. An erectable tent structure according to claim 1 wherein each said anchor means includes a triangularly shaped anchor section joined to the periphery along a peripheral portion thereof located between adjacent ones of the peaks so as to span a respective said valley mouth, said anchor sections each extending outwardly from the periphery to terminate in a anchor vertex which may be secured to said support surface.

4. An erectable tent structure according to claim 3 including a plurality of anchor stakes adapted to be driven into said support surface and an anchor shoe attached to each anchor panel free end, each said anchor shoe adapted to cooperatively and releasably engage a respective said anchor stake.

5. An erectable tent structure according to claim 3 wherein adjacent ones of said anchor panels form an archway having a crest located proximate to the periphery.

6. An erectable tent structure according to claim 5 wherein said anchor sections have anchor side edges which converge to form the vertex thereof, and including reinforcing webbing strips along each anchor side edge so that said archways are bounded by said reinforcing webbing strips.

7. An erectable tent structure according to claim 1 including a peak mounting ring secured to said roof covering at each of said peaks thereof, said support poles each including means for cooperatively engaging a respective one of said mounting rings.

8. An erectable tent structure according to claim 7 including a central mounting ring secured to said roof covering at said central portion and wherein said covering includes first web strips attached thereto along said ridgelines and interconnecting each said peak mounting ring to said central mounting ring and second web strips attached thereto along said valley floors and extending from the periphery to connect to said central mounting ring.

9. An erectable tent structure adapted to be erected on a support surface to provide a sheltered space, comprising:

(a) a flexible roof covering having a periphery and including a central portion and a plurality of ridge portions having inclined slopes and each extending radially outwardly from said central portion along a ridge line to terminate in a peak located proximate to the periphery for said covering so that the inclined slopes of adjacent ones of said ridge portions form valley portions, each said valley portion extending radially outwardly from said central portion between a pair of adjacent ridge portions to terminate in a valley mouth located proximate to the periphery between the peaks of said adjacent ridge portions, each of said valley portions having a valley floor so that the inclined slopes forming each respective valley portion extend upwardly from said valley floor oppositely one another to said ridge portions, said roof covering constructed of a plurality of roof sections each constructed of a pair of roof panels connected to one another along a primary seam that extends from a respective said peak to said central portion to define a respective ridgeline therefor, and adjacent ones of said roof sections being joined to one another along secondary seams to form said valley portions. said secondary seams defining said valley floors;

(b) a plurality of support poles each having an effective length and operative to support said flexible roof covering in an erected state above said support surface, there being one of said support poles associated with each said roof section so that each said support pole may be positioned between said support surface and a respective one of said peaks; and (c) a plurality of anchor means for securing said flexible covering to said support surface whereby a ridge tension force is applied along each primary seam in a direction upwardly and outwardly with respect to said central portion and whereby a valley tension force is applied along each secondary seam in a direction downwardly and outwardly with respect to said central portion so that said flexible covering is held taut when in the erected state with said central portion being oriented in a plane parallel to said support surface, said covering configured so that, in the erected state, said ridgelines each extend above said plane and said valley floors extend below said plane.

10. An erectable tent structure according to claim 9 wherein each of said roof panels is constructed of a pair of triangular roof panel pieces having edges joined to one another along a tertiary seam that extends radially outwardly from said central portion to the periphery.

11. An erectable tent structure according to claim 10 wherein each of said roof panel pieces is constructed of a fabric material having a set of warp threads and a set of weft threads, said roof panel pieces being cut and sewn together so that both said primary and secondary seams are each parallel to one of said sets of warp and weft threads of the associated said roof panel piece.

12. An erectable tent structure according to claim 11 wherein said edges of said roof panel pieces which are joined to form said tertiary seams are swarf cut edges.

13. An erectable tent structure according to claim 9 wherein each of said support poles includes means for adjusting the effective length thereof whereby the ridge and valley tension forces may be selectively varied.

14. An erectable tent structure according to claim 9 wherein each said anchor means includes a triangularly shape anchor section connected to the periphery along a respective peripheral portion thereof, each said peripheral being located either between a pair of adjacent peaks or between a pair of adjacent valley floors.

15. An erectable tent structure according to claim 14 wherein adjacent ones of said anchor sections form an archway having a crest located proximate to said periphery.

16. An erectable tent structure according to claim 9 including web strips disposed along each of said primary and secondary seams and joined therewith to reinforce each of said primary and secondary seams against the ridge and valley tension forces, respectively.

17. An erectable tent structure adapted to be erected on a support surface to provide a sheltered space, comprising:

(a) a flexible roof covering having a periphery and including a central portion and a plurality of ridge portions having inclined slopes and each extending radially outwardly from said central portion along a ridgeline to terminate in a peak located proximate to the periphery for said covering so that the inclined slopes of adjacent ones of said ridge portions form valley portions, each said valley portion extending radially outwardly from said central portion between a pair of adjacent ridge portions to terminate in a valley mouth located proximate to the periphery between the peaks of said adjacent ridge portions, each of said valley portions having a valley floor so that the inclined slopes forming each respective valley portion extend upwardly from said valley floor oppositely one another to said ridge portions;

(b) a plurality of support poles each having an effective length and operative to support said flexible covering in an erected state above said support surface, there being one of said support poles associated with each said peak such that each said support pole may be positioned between said support surface and a respective one of said peaks; and (c) a plurality of anchor means for securing said flexible covering to said support surface whereby a ridge tension force is applied along each ridgeline in a direction upwardly and outwardly with respect to said central portion and whereby a valley tension force is applied along each valley floor in a direction downwardly and outwardly with respect to said central portion so that said flexible covering is held taut when in the erected state with said central portion being located in a plane parallel to said support surface, each said anchor means including a triangularly shaped anchor section joined to the periphery along a peripheral portion thereof located between adjacent ones of the valley mouths so as to span a respective said peak, said anchor sections each extending outwardly from the periphery to terminate in an anchor vertex which may be secured to said support surface, said covering configured so that, in the erected state, said ridgelines each extend above said plane and said valley floors extend below said plane.

18. An erectable tent structure according to claim 17 including a plurality of anchor stakes adapted to be driven into said support surface and an anchor shoe attached to each anchor panel end, each said anchor shoe adapted to cooperatively and releasably engage a respective said anchor stake.

19. An erectable tent structure according to claim 17 wherein adjacent ones of said anchor sections form an archway having a crest located proximate to said periphery.

20. An erectable tent structure according to claim 19 wherein said anchor sections have anchor side edges which converge to form the vertex thereof, and including reinforcing webbing strips along each anchor side edge so that said archways are bounded by said reinforcing webbing strips.

* * * * *